US005807621A

United States Patent [19]

Kite et al.

[11] Patent Number: 5,807,621

[45] Date of Patent: Sep. 15, 1998

[54] CASTING PAPER

[75] Inventors: Nicholas John Kite, Wycombe; Peter Sinclair, Amersham; Roger Anthony Allen, Missenden, all of England; Neil Harvey Clifford, Aberdeen, Scotland

[73] Assignee: The Wiggins Teape Group Limited, England

[21] Appl. No.: 733,921

[22] Filed: Oct. 18, 1996

[30] Foreign Application Priority Data

Oct. 18, 1995 [GB] United Kingdom ..... 9521276

[51] Int. Cl.[6] ..... B05D 3/12; B05D 3/02; B05D 5/02

[52] U.S. Cl. ..... 428/151; 427/278; 427/274; 427/362; 427/361; 427/391; 428/153; 428/537.5

[58] Field of Search ..... 427/278, 274, 427/362, 361, 391; 428/151, 153, 537.5; 101/32

[56] References Cited

U.S. PATENT DOCUMENTS

| | | | |
|---|---|---|---|
| 3,535,413 | 10/1970 | Glenn . | |
| 3,535,417 | 10/1970 | Henkes . | |
| 3,758,649 | 9/1973 | Frattarola . | |
| 3,882,207 | 5/1975 | Hannan et al. . | |
| 3,933,558 | 1/1976 | Takahata et al. . | |
| 4,257,842 | 3/1981 | Ciaccia et al. . | |
| 4,279,964 | 7/1981 | Heller . | |
| 4,321,760 | 3/1982 | Meier | 34/155 |
| 4,500,484 | 2/1985 | Gregg . | |
| 4,547,141 | 10/1985 | Ruschmann . | |
| 4,581,257 | 4/1986 | Kondo et al. | 427/336 |
| 4,608,221 | 8/1986 | Kurtz et al. . | |
| 4,744,936 | 5/1988 | Bittner, Jr. . | |
| 4,929,474 | 5/1990 | Avni et al. | 427/326 |
| 4,959,264 | 9/1990 | Dunk et al. | 428/331 |
| 5,164,227 | 11/1992 | Miekka et al. | 427/162 |
| 5,203,941 | 4/1993 | Spain et al. . | |
| 5,232,535 | 8/1993 | Brinley | 156/219 |
| 5,275,846 | 1/1994 | Imai et al. | 427/362 |
| 5,318,943 | 6/1994 | Ueno et al. | 503/227 |

FOREIGN PATENT DOCUMENTS

| | | |
|---|---|---|
| 1011638 | 6/1977 | Canada . |
| 142338 | 5/1985 | European Pat. Off. . |
| 276048 | 7/1988 | European Pat. Off. . |
| 223507 | 10/1974 | France . |
| 2297271 | 8/1976 | France . |
| 55-013030B | 4/1980 | Japan . |
| 62-101438A | 10/1985 | Japan . |
| 62071615A | 4/1987 | Japan . |
| 601796 | 5/1948 | United Kingdom . |
| 612982 | 11/1948 | United Kingdom . |
| 1540056 | 2/1979 | United Kingdom . |
| WO89/03760 | 5/1989 | WIPO . |

OTHER PUBLICATIONS

"The Purpose and Methods of the Embossing Process", George W. Zwerver, Paper Film & Foil Converter, Jan. 1980, pp. 66, 68, 70.

"Focus on Embossing/Embossing of Thermoplastic Films", Meccaniche Colombo, Converter, Jun. 1987, pp. 21–24.

(List continued on next page.)

*Primary Examiner*—Shrive Beck
*Assistant Examiner*—Michael Barr
*Attorney, Agent, or Firm*—Burns, Doane, Swecker & Mathis, L.L.P.

[57] ABSTRACT

Casting paper of a desired surface texture or finish for use in the manufacture of artificial leather is produced by heating the polymer coating 1 of a polymer-coated paper 2 to a temperature sufficient to melt the polymer and then cooling the polymer coating from its molten state to a solid state as it passes through a nip between an embossing roll 3 having a surface configuration corresponding to said desired surface texture or finish and a backing roll 4, thereby to impart the surface configuration of the embossing roll to the polymer-coated paper. The polymer is preferably polyolefinic, for example poly (4-methyl-1-pentene) or a polypropylene/polyethylene blend. An anti-curl back-coat, for example of polyvinyl alcohol, can be applied after the embossing operation.

18 Claims, 3 Drawing Sheets

OTHER PUBLICATIONS

"Prägen von Papier und Pappe", J. Schlunke, Wochenblatt Für Papierfabrikation, 21, 1976, pp. 824–827.

"Elementary Embossing, Dear Watson", Robert B. Kramer, 1984 Polymers, Laminations and Coatings Conference/TAPPI Proceedings, pp. 173 and 174.

"Web Processing and Converting Technology and Equipment", Edited by Donatas Satas, Van Nostand Reinhold Company, 1984, pp. 485–510.

"An Engineering Study of the Film Embossing Process", M.R. Kamal, A. Haber and M.E. Ryan, Polymer Engineering and Science, mid–Aug. 1985, vol. 25, No. 11, pp. 698–713.

CASTING PAPER

This invention relates to the manufacture of casting paper of the kind carrying a coating of a thermoplastic polymer. Such paper is used in the production of artificial leather for use in shoes, luggage, fashion accessories, and such like. The thermoplastic polymer is typically an extruded polyolefin such as polypropylene, a polypropylene/polyethylene blend or poly (4-methyl-1-pentene).

The manufacture of artificial leather using such paper typically involves applying a curable plastisol composition, usually based on a polyvinyl chloride (PVC) or polyurethane, to a polymer-coated paper which has previously been provided with a desired leather-like surface finish. The plastisol composition is then dried and cured, after which the cured film is stripped from the polymer-coated paper to provide the artificial leather. The surface finish of the polymer-coated paper is "cast" into the surface of the artificial leather product during the process just described, and so the polymer-coated paper is termed "casting paper" or "film casting paper".

For economic reasons, the casting paper must be capable of repeated re-use. This requires the polymer coating to have good temperature stability and thermal durability, since it is exposed to high temperatures during each curing operation (typically 210° C. or more in the case of PVC artificial leathers).

A wide variety of different leather effects, ranging from smooth glossy patent to rough hide, can be obtained by the use of appropriate casting paper finishes. These are usually imparted to the polymer coating of the casting paper by the use of a precision-engraved embossing roll. The plastics material deforms in the embossing nip to take up a surface configuration which replicates that of the embossing roll and simulates that of a natural leather. In order to facilitate this deformation, the embossing roll is heated to a temperature sufficient to soften the polymer coating.

Although casting papers manufactured as described above have been widely used, there is a limit to the quality of surface finish which they can impart to the final artificial leather product. The main limitations are the depth of emboss obtainable and the level of replication of the fine detail of the engraved leather design.

These drawbacks can be overcome by the use of a polymer coating produced by electron beam (EB) curing of suitable monomers instead of an extruded thermoplastic coating. These EB-curable materials are initially liquid and are cured to a solid state whilst they are in contact with the surface of a precision-engraved moulding roll. Surface replication is therefore excellent, because in the initial liquid state, the polymer precursor material can flow readily and completely into the "valleys" of the surface to be replicated.

Although the EB-curing route can give a very high quality product, it has the disadvantage of requiring expensive raw materials and specialized equipment for the curing operation. A further drawback is that EB cured products can generally be used for fewer leather casting operations than polyolefin-coated products. This is because EB-cured coatings are more brittle, and hence more liable to crack, than polyolefin coatings.

There is therefore a need for an improved embossed polyolefin-coated casting paper which matches or approaches the quality of surface finish obtainable with EB-cured casting paper products whilst not possessing the usual drawbacks of those products. Separately from this, there is a need for a reduction in the cost of production of embossed polyolefin casting papers through the achievement of higher production speeds, less downtime, etc. The present invention seeks to meet these needs.

The main factors underlying the above-identified problems in the conventional production of embossed casting papers will now be discussed in more detail.

In one process, embossing is carried out in a nip between an engraved roll carrying the design to be applied and a backing roll. The backing roll can have a protective covering, so as to avoid damage to the surface of the embossing roll. The covering is typically of cotton, a blend of cotton and wool, or a polymer. Despite the covering, the surface of the backing roll is relatively hard, with the result that it does not fully deform in conformity with the embossing roll surface with which it forms a nip. This limits the extent to which the polymer coating of the casting paper is brought into intimate contact with the engraved surface of the embossing roll and also limits the depth of the emboss imparted to the supporting paper (since the paper typically makes up about 80% of the total thickness of the casting paper, it is important that the paper should be embossed as well as the polymer coating). These factors together lead to poor replication of the embossing roll surface, both in terms of the depth of emboss obtainable and reproduction of fine detail.

The above-described problems can be alleviated, but not eliminated, by the use of "geared" embossing and backing rolls, i.e. rolls which are driven in synchronism such that as they rotate, any particular portion of the circumference of the embossing roll always contacts the same portion of the circumference of the backing roll. The covering on the backing roll in this type of process is normally of cotton, and each portion of the backing roll surface deforms so as to complement the corresponding portion of the surface of the embossing roll . This process is facilitated by "washing" the embossing roll design into the cotton backing roll surface, i.e. using water to soften the backing roll surface as the embossing and backing rolls are rotated in nip pressure contact (with no paper between them). The softened backing roll then deforms more readily to match the surface of the embossing roll. This enables a greater depth of emboss to be achieved in both the polymer coating and the underlying paper, but it is still less than that of the embossing roll surface. Also, reproduction of fine surface detail remains a problem as the softened plastics material will still not come into sufficiently close and intimate contact with the embossing roll surface to reproduce all its features accurately.

A drawback of geared roll sets is that they reduce production flexibility. This is because a geared embossing roll has to be run with a particular backing roll on a particular embossing machine. This constraint does not apply to the same extent with "flat backed" roll sets, i.e. non-geared sets. A further drawback is that the washing process is very time consuming, and therefore results in significant non-productive downtime.

In an alternative process, a pair of matched geared precision-engraved steel rolls are used for applying the emboss. These rolls are mounted at a fixed small spacing from one another which is less than the thickness of the polymer-coated web to be embossed. The thickness of the polymer-coated paper is greater than the spacing between the rolls, and so there is an embossing action as the polymer-coated paper passes between the rolls. Whilst this system gives good replication, it has a high capital cost because two expensive precision-engineered and accurately-mounted rolls are required.

The fine surface detail referred to earlier comprises not just fine "peak" and "valley" features of the grain of the leather, but also so-called "two-tone" effects. It is these which give the artificial leather a lifelike or realistic appearance. They result primarily from contrast between glossiness in the "peaks" of the engraved design and mattness in the "valleys", or vice versa. This contrast effect is not reliably obtained if there is not consistent close and intimate contact between the softened polymer coating and the bottom of the "valleys" of the engraved embossing roll surface.

An expedient sometimes used for dealing with this problem is to use a matt polymer-coated casting paper. Poor surface replication of the bottoms of the valleys leaves this mattness untouched, whereas parts of the polymer-coated surface in contact with the peaks of the engraved design are rendered glossy because there is good contact between the polymer and the peaks of the engraved surface. If on the other hand glossy valleys and matt peaks are required, then a glossy polymer-coated paper can be used. However, these expedients are not entirely satisfactory because the degree of close contact between the softened polymer coating and the detail of the engraved design is erratic and unpredictable, so that consistency in achievement of the desired two-tone effect is hard to obtain. A further disadvantage is that the matt or gloss level in the valleys is always the same, resulting in a less lifelike appearance.

One reason why the deformation of softened polymer into contact with the design is erratic and unpredictable with the current process is that the deformation characteristics of the polymer in response to embossing pressure are very temperature-dependent. Thus even slight fluctuations in the temperature of the embossing roll surface, or slight variations in the uniformity of the temperature across the surface of the embossing roll will result in variations in the extent to which the engraved embossing roll design is replicated. Such temperature fluctuations and variations are hard to avoid, as heat is continually lost from the embossing roll to the paper, and very complicated, and hence expensive, roll constructions are needed to achieve uniform surface temperatures.

Conventional embossing processes as used in the manufacture of casting paper are also very limited in terms of the production speeds which can be achieved. This is primarily because the embossing roll has several distinct functions which each require a minimum dwell time in the nip. Firstly, the roll must supply sufficient heat to the polymer coating for softening to occur. Secondly, the nip pressure must cause the polymer to be displaced so that it takes up the surface configuration of the embossing roll. Thirdly, the dwell time in the nip must be sufficient for the supporting base paper web to be permanently deformed—if the dwell time is too short, the paper web tends to "spring back" once the pressure is removed, so reducing the permanence of the embossed design. If the production speed is too high and the dwell time in the nip is correspondingly low, these objectives will not be achieved.

The ability to accept an emboss is not the only significant feature of the base paper. It must above all be capable of forming a strong bond with the polymer coating, or else there is a danger of delamination of the polymer from the base paper when the cured artificial leather film is stripped from the casting paper. This requires that the base paper should be rough, so as to provide a good key for the extruded polymer film.

The need for a good bond between the paper and the polymer coating imposes other restrictions as well. Thus the use of alkyl ketene dimer sizes, or other internal sizes with release properties, must be a voided or minimised, as otherwise the polymer/paper bond is weakened. This is a serious drawback as such sizes can provide great benefits to the papermaker. For the same reason, use of starch surface size must be minimised. This in turn means that little or no particulate mineral filler can be used in the paper, as otherwise the low surface sizing levels will lead to escape of free filler particles, usually termed "dusting", in use of the paper to produce artificial leather.

The net result of all these requirements is a base paper which has the requisite high roughness, but suffers from poor formation (i.e. evenness of constituent fibre distribution), high moisture content (as a consequence of the low filler content) and poor dimensional stability. This can lead to curl problems, since once the paper is polymer coated, expansion or contraction of the paper is not matched by corresponding expansion or contraction of the polymer. In addition, the absence or near-absence of mineral filler leads to a substantial cost penalty. Furthermore, although roughness is necessary to achieve the necessary bonding with the polymer, it is undesirable in other respects and it would in general be preferable to be able to use a smoother base paper, for example to reduce the polymer demand, i.e. the amount of polymer needed to give a coating of a desired minimum thickness.

SUMMARY OF THE INVENTION

After detailed study of all the various problems discussed above, we concluded that a fundamental change in approach was necessary. Thus instead of the conventional use of the embossing roll to raise the temperature of the polymer and thereby soften it so that it could be deformed to take up the surface finish of the embossing roll, we conceived the idea of pre-heating the polymer to a molten state prior to contact with the embossing roll and then using the embossing roll to cool the molten polymer and re-solidify it while it is in intimate contact with the embossing roll. The initial molten state of the polymer permits it to flow readily and completely into the valleys of the embossing roll surface, giving a good depth of emboss and full replication of fine detail, including two-tone effects.

Accordingly, the present invention provides, in a first aspect, a method of producing casting paper of a desired surface texture or finish, comprising the steps of heating the polymer coating of a polymer-coated paper to a temperature sufficient to melt the polymer and then cooling the polymer coating from its molten state to a solid state as it passes through a nip between an embossing roll having a surface configuration corresponding to said desired surface texture or finish and a backing roll, thereby to impart the surface configuration of the embossing roll to the polymer-coated paper.

In a second aspect, the present invention provides surface-textured casting paper produced by a method as just defined.

In a third aspect, the present invention relates to surface-cast products made using casting paper according to the second aspect of the invention.

Preferably, the surface of the surface-finishing roll is itself heated to a temperature well above ambient but below the melting point of the polymer. This avoids too rapid solidification, and by keeping the polymer warmer for longer in the nip, allows the polymer to mould itself more exactly to the configuration of the embossing roll. The optimum embossing roll temperature depends on a number of factors, principally the melting point of the particular polymers being used and the web speed. The latter determines the dwell time in the nip and thus has a strong influence on the rate of heat abstraction from the initially molten polymer. By way of example, we have found that for polypropylene polymer coatings containing a proportion of lower-melting polyethylene, and a 135 g $m^{-2}$ paper web with a polymer coatweight of 28 g $m^{-2}$ running at about 15 m $min^{-1}$, an embossing roll surface temperature of around 80° C. to 100° C. is suitable. For poly (4-methyl-1-pentene) coatings with a similar base paper, polymer coatweight and web speed, higher embossing roll surface temperatures can be used if desired, say 120°–130° C., although we have found temperatures in the 80° C. to 100° C. range still to be suitable. It will be appreciated in this regard that the embossing roll surface will also be warmed by contact with the hot polymer-coated paper, and that this effect must be allowed for in determining how much to heat the embossing roll.

Since there is a large differential between the temperature of the pre-heated molten polymer and the temperature of the embossing roll, minor variations or fluctuations in the temperature of the embossing roll are not significant, unlike in the case of the prior art process described above.

Pre-heating of the polymer to melt it before it enters the nip is preferably carried out by one or more gas or electric infra-red radiant heaters, although in principle other heating means could be used, for example hot air or induction heating. The heaters should be positioned sufficiently close to the nip to preclude cooling of the polymer to below its melting point before it enters the nip.

The polymer should be fully melted in order to achieve the best results. This typically requires temperatures of the order of 220° C. to 240° C. or more in the case of poly (4-methyl-1-pentene) and 140° C. or more in the case of typical currently-used polypropylene/polyethylene blends. If a proportion of unmelted material is present, then small areas or spots of poor surface replication are likely to occur.

In a preferred embodiment of the process, moisture is applied to the reverse (paper) surface of the polymer-coated paper whilst and/or before it is pre-heated to melt the polymer. This moisture application is preferably by means of steam showers, but in principle, alternatives could be used, for example fine water sprays or a Dahlgren LAS system.

The use of steam showers or other means of moisture application compensates for the moisture driven off by the infra-red heaters and cools the paper, so preventing it from drying out and counteracting the tendency of the paper to curl. The moisture applied also serves to soften or plasticise the paper to a certain extent, so making it more receptive to the emboss. The moisture applied is also beneficial in counteracting any build up of static electricity.

If too much steam is applied, then the paper can become wet, in which case it weakens and may even break. It has to be borne in mind in this context that once the polymer coating has melted, it ceases to contribute to the overall strength of the paper. Maintenance of the strength of the base paper is therefore very important. A further problem is that once the polymer coating on the opposite surface of the paper has melted, at a temperature of 220° C. to 240° C. or more, there is a risk that the steam will cool the polymer to below its melting point. Thus control and placement of the steam showers can be critical to the success of the process, and the optimum conditions for any particular production installation therefore need to be established by experiment.

Whereas the web speed obtainable in the prior art process is constrained by the need to allow sufficient dwell time in the nip for the polymer to soften and for the softened polymer to move slowly into the valleys of the embossing roll surface, no such constraint applies to the present process. Melting of the polymer by infra-red heaters is very rapid, and since the polymer is molten, rather than merely soft, it flows rapidly into all the valleys of the roll surface.

A further benefit of the present process is that it permits the use of a smoother base paper than with the conventional embossing process. This is thought to be because the melting of the polymer enhances contact with the fibres of the base paper, particularly as the passage through the nip forces the initially molten polymer into the paper surface to some extent. The elimination of the need for a rough surface permits the paper furnish to be modified to reduce the proportion of softwood pulp and to improve formation, stiffness and dimensional stability. Better formation results in a final product of a more attractive appearance. Better stiffness and dimensional stability reduces the propensity of the product to curl during the various heating and cooling cycles to which it is subjected in use in artificial leather production.

The better polymer/paper bonding which results from the use of the present process permits the use of alkyl ketene dimer (AKD) internal sizing and starch surface sizing. The latter in turn counteracts any tendency to dusting, and hence mineral filler loadings can be used at higher levels than in the conventional product. This enables substantial cost reductions to be achieved, although a balance has to be struck because increased filler contents reduce stiffness and hence can increase the tendency for the final product to curl. Although the present invention facilitates the use of AKD sizing, it will be understood that rosin/alum sizing can be used if desired.

In a further preferred embodiment of the present process, the paper is moisture treated (i.e. steam-treated or water-treated) on its reverse (paper) surface after embossing has been carried out and prior to reeling up the paper. This has been found to reduce the curling tendency of the paper after storage. The use of steam or water in this way also helps to eliminate any build up of static electricity on the casting paper. However separate anti-static devices, e.g. of the radiation or discharge type, can be used instead of or in addition to steam or water treatment.

Curling problems can be particularly serious with casting papers to which several curable coatings are applied in sequence as part of the later casting operation. Each coating operation is followed by heating to effect curing and the rapid heating and cooling which results can lead to differential expansion and contraction in the various layers, and thus to severe curl.

We have now found that such curling can be effectively countered by the application, after the embossing stage, of a back coat of a hydrophilic polymer such as starch. However, whilst a starch coating can produce an initially flat product, this flatness may not be maintained on exposure to very high temperatures, for example 200° C., which the paper might have to undergo during the later casting operation. However we have found it possible to enhance product flatness under such conditions by the application of a polyvinyl alcohol back coating after the embossing stage. A fully-hydrolysed medium molecular weight polyvinyl alcohol is particularly suitable. The back-coating operation can be on- or off-line.

Apart from the use of a modified base paper as described above, the polymer-coated paper can be as conventionally used in the manufacture of embossed casting papers. Whilst the polymer is typically a polyolefin of the kind referred to previously, other types of meltable polymers could be used in principle. Similarly, whilst the polymer is normally applied to the paper in an extrusion-coating operation, other coating techniques are feasible.

Whilst the present invention is particularly suited to the production of casting paper giving fine- or coarse-grained effects, it can in principle be used for the production of smooth finishes, for example of the glossy patent leather type. The expression "embossing roll" as used in this specification embraces a smooth-surfaced roll such as would be required to produce such an effect.

BRIEF DESCRIPTION OF THE DRAWINGS

In order to enable the invention to be more readily understood, reference will now be made to the accompanying drawings, which illustrate diagrammatically and by way of example only, an embodiment thereof and an embodiment of a conventional process, and in which.

In the drawings, like reference numerals are used to denote like features.

DETAILED DESCRIPTION OF THE INVENTION

Figure 1:
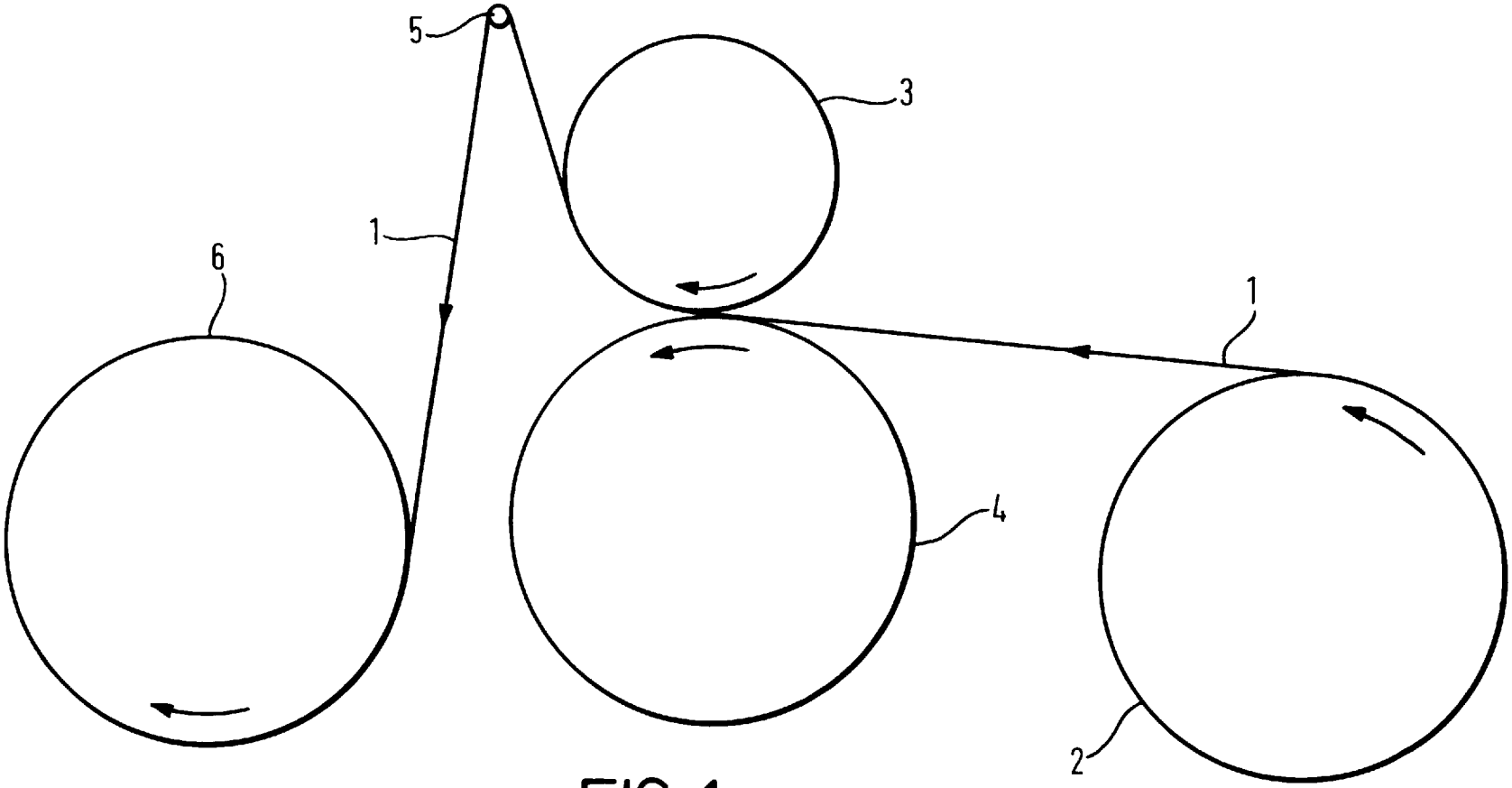
FIG. 1 is a schematic side view of a conventional process for the production of embossed casting paper.

Referring first to FIG. 1, a web 1 of polymer-coated paper is unwound with its polymer-coated surface uppermost from an unwind reel 2 and passed through a nip between a steel embossing roll 3 and a backing roll 4. The embossing roll 3 is precision-engraved with the design required in the final casting paper and is heated by conventional hot oil or hot water heating means (not shown) to a temperature above the softening point of the polymer (typically 110° C. if the polymer is polypropylene or a polypropylene/polyethylene blend, or 120° C. if the polymer is a low softening-temperature grade of poly (4-methyl-1-pentene). The backing roll 4 carries a cotton or other compliant covering (not shown separately). After emerging from the nip, the embossed web passes via a guide roll 5 to a reel-up station where it is reeled up into a finished reel 6.

Figure 2:
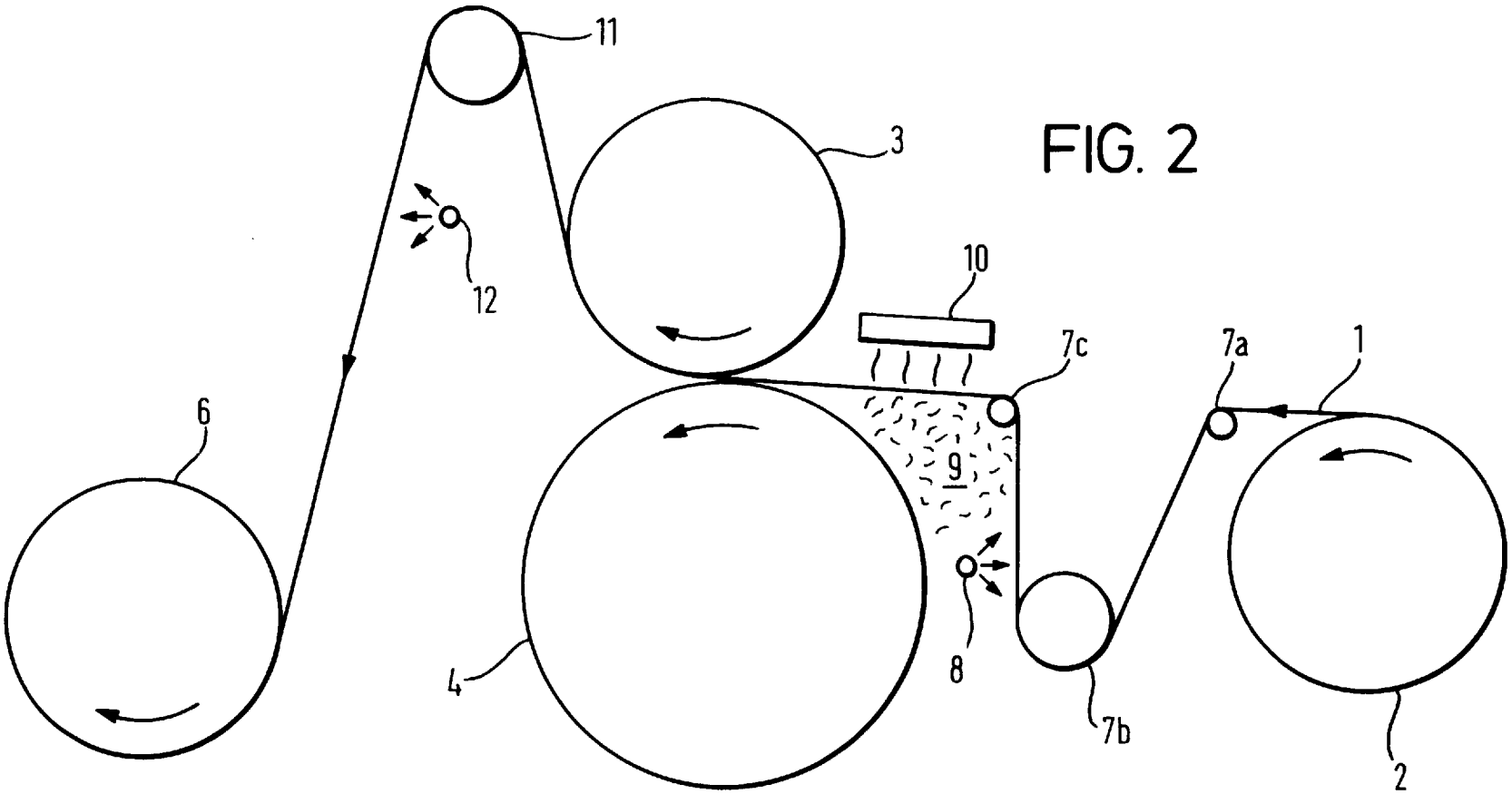
FIG. 2 is a schematic side view of a process according to the invention.

Referring now to FIG. 2, a web 1 of polymer-coated paper is unwound from an unwind reel 2, passed through a nip between embossing and backing rolls 3 and 4 respectively, and reeled up into a finished reel 6, all as generally described with reference to FIG. 1. However, instead of passing directly between the reel 2 and the embossing nip, the web passes round a series of guide rolls 7*a*, 7*b* and 7*c* before resuming its passage directly towards the nip. A steam shower 8 is positioned between the guide rolls 7*b* and 7*c* so as to direct steam at the exposed paper surface of the polymer-coated web. The web path between the guide roll 7*b*, the guide roll 7*c* and the nip is such as to create a chamber generally indicated as 9. Steam from the steam shower 8 can billow within this chamber to create a humid atmosphere. The steam thus has a greater effect on the web than if it were unconfined. The purpose of the steam is as described previously.

A gas or electric infra-red heater or bank of heaters 10 is positioned above the web between the guide roll 7*c* and the embossing nip, so as to melt the polymer coating. The heaters, the web speed, the rate of steam application and the ambient conditions are such that the polymer coating is still in a molten condition when it enters the nip. The embossing roll 3 is heated, but only to a temperature below the melting point of the polymer (typically by means of heating fluid at a temperature of about 80° C.). The result is that on emerging from the nip, the polymer coating has re-solidified with a surface configuration replicating that of the embossing roll. After leaving the nip, the web passes around a cooling roll 11 before passing to the reel-up station. An additional steam shower 12 is positioned between the cooling roll 11 and the reel 6 so as to apply moisture to the exposed paper surface of the web to reduce curl in the finished product and to counter build up of static electricity.

Although the present invention has been described primarily in relation to the production of casting paper for use in the manufacture of artificial leather, it can be used for applying a desired surface finish to casting paper to be used for other purposes, for example surface-textured decorative laminates. The manufacture of such products typically involves bonding a thermosetting resin-impregnated decorative surface sheet to one or more structural layers under the influence of heat and pressure. These structural layers are usually of strong paper, chipboard, particle board or plywood. A casting paper can be used to impart a desired fine surface texture to the decorative surface of the finished laminate before being stripped off. As an alternative to imparting the surface finish during the laminating operation, casting paper can be used to texture a plastics film or coating which has been previously applied to a support.

The invention will now be illustrated by the following Examples, in which all parts and percentages are by weight unless otherwise stated:

EXAMPLE 1

A ca. 163 g $m^{-2}$ polypropylene/polyethylene blend coated casting paper (28 g $m^{-2}$ of polymer on a 135 g $m^{-2}$ AKD-sized base paper containing a 10% loading of calcium carbonate) was embossed with a kid leather design using the process as generally described with reference to FIG. 2, except that no application of steam was made prior to melting the polymer.

The web speed was 15 m $min^{-1}$. One gas ceramic infra-red heating unit was used, positioned about 1 cm from the surface of the embossing roll (5–6 cm in advance of the embossing nip) at a vertical spacing of about 15 cm from the web. The heating unit extended across the entire width of the web, and its dimension in the direction of web movement was 27.5 cm. The heating unit had a rating of 45000 Btu $hr^{-1}$ $ft^{-2}$ (c.511 mJ $hr^{-1}$ $m^{-2}$) and was capable of reaching a maximum face temperature of about 850° C.

The gas flow was adjusted until the polymer was observed to be completely molten across the width of the sample with no spots where melting was incomplete. The surface temperature of the polymer was in excess of 160° C., as measured by a non-contracting infra-red thermometer.

The embossing roll was heated by means of hot water to a target temperature of 80° C. Its surface temperature at the end of the embossing run was 86° C., as measured just inside the line of the web path using a contacting thermocouple device.

The embossed product produced and a control sample of the same design produced by a conventional process as generally described with reference to FIG. 1 were then compared. The embossing roll used to produce the control sample had been heated by means of pressurised hot water to a target temperature of 105° C. The comparison involved using a Hommeltester T2000 (a stylus surface topography instrument produced by Hommelwerke GmbH or their UK associate Hommel (UK) Ltd.) to generate centre line average roughness values ($R_a$) and maximum roughness height values ($R_{max}$) for the two samples. The $R_a$ and $R_{max}$ parameters and the method for their measurement are described in International Standard ISO 4287 and German Standard DIN 4768 respectively.

The results obtained were as follows:

| Sample | $R_a$ (μm) | $R_{max}$ (μm) |
|---|---|---|
| Invention | 8.4 | 53 |
| Control | 6.9 | 38 |

It will be seen that the emboss depth achieved with the present process was much greater than with the control sample.

EXAMPLE 2

This illustrates the use of steam application to the reverse (paper) surface of the web.

A poly (4-methyl-1-pentene) polymer coated casting paper (28 g $m^{-2}$ polymer, base paper as in Example 1) was embossed to give a gloss finish by a process generally as described in the first part of Example 1. The target emboss roll temperature was 80° C. and the final measured temperature was 89° C. The web speed was 9.5 m $min^{-1}$ and the surface temperature of the melted polymer was in excess of 250° C. Runs were carried out with and without steam application just before the infra-red heating unit.

Polyurethane artificial leather casts were made from the resulting casting papers. The gloss level of these casts were compared. The higher the gloss the better the reproduction of the finish of the embossing roll. The results were as follows:

| | Gloss (%) |
|---|---|
| Sample from paper embossed with steam treatment | 42 |
| Sample from paper embossed without steam treatment | 40 |

EXAMPLE 3

A casting paper as described in Example 2 was embossed with a kid leather design using the with-steam process as described in Example 2, except that the web speed was slightly higher (10 m $min^{-1}$).

The resulting embossed paper and an initially matt control paper embossed with the same design by the prior art process were assessed using stylus surface topographic analysis, as described in Example 1. The results obtained were as follows:

| Sample | $R_a$ (μm) | $R_{max}$ (μm) |
|---|---|---|
| Invention | 4.1 | 28 |
| Control | 2.0 | 23 |

Figure 3A:
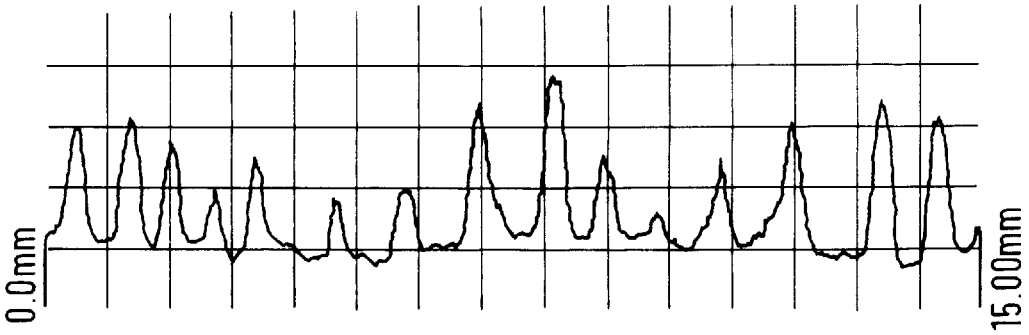
FIGS. 3*a* and 3*b* are surface profile traces to be described subsequently with reference to Example 3.
Figure 3B:
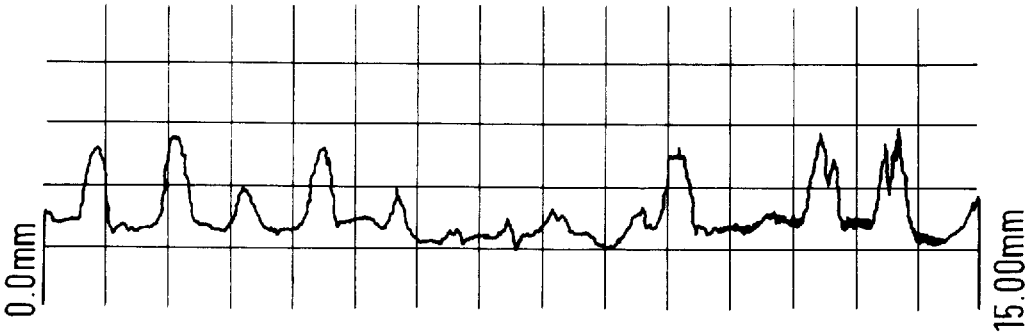

It will be seen that the emboss depth achieved with the present process was much greater than with the control sample. The difference can be seen visually on FIGS. 3*a* and 3*b*, which are surface profile traces of representative portions of the sample produced according to the invention and the control sample respectively.

Polyurethane artificial leather casts were then made from each sample. The degree of "two-tone" effects (as described previously) achieved in each case were then compared visually. It was observed that the cast made from the paper according to the invention had a much better two-tone effect, i.e. it was much more life-like, than the cast made from the control paper. The difference between the two samples could also be detected tactilely.

EXAMPLES 4a and 4b

These illustrate the use of polyvinyl alcohol and starch backcoats to counteract curling of the final casting paper during later casting operations. The casting paper was produced from a ca. 163 g $m^{-2}$ poly (4-methyl-1-pentene) polymer coated paper. This had been prepared in conventional manner by extruding ca. 28 g $m^{-2}$ of polymer on to a ca. 135 g $m^{-2}$ casting base paper produced from a 60% softwood/40% hardwood finish internally sized with a rosin/alum sizing system.

(a) Polyvinyl Alcohol Backcoat

A web of the polymer-coated paper just described was embossed with a kid leather design using a process and apparatus generally as described in FIG. 2. The web speed was 25 m $min^{-1}$, and melting of the polymer was by means of a pair of heating units each as described in Example 1. An even "melt line" was clearly visible. The embossing roll was internally heated by hot water and by contact with the heated casting paper and its embossing surface reached an equilibrium temperature of ca. 120° C. during a long (2000 m) production run. Steam was applied to the reverse (uncoated) surface of the paper both before and after embossing, the paper having been passed round a cooling roll prior to the second application of steam. The paper was reeled up after the second application of steam.

In a subsequent separate off-machine air knife coating operation, an 8% solids content solution of substantially fully-hydrolysed medium molecular weight polyvinyl alcohol (Mowiol* 10/98 manufactured by Hoechst A.G. and supplied by Harco of Harlow, England) was applied to the exposed paper surface of the embossed casting paper at a coating speed of ca. 200 m $min^{-1}$. The dry pick-up (coatweight) was ca. 2 g $m^{-2}$. The paper was reeled-up, after drying, at which stage its moisture content was approximately 5%.

* Mowiol is a trade mark (b) Starch Backcoat

The procedure was as described a (a) above except that the emboss applied was a calf leather design and the backcoat was a ca. 3 g $m^{-2}$ (dry) coating of modified maize starch acetate (Kofilm*50 supplied by National Starch & Chemical, Slough, England) applied by means of an air-knife coater at 7–8% solids content.

* Kofilm is a trade mark

Curl Evaluation

The papers from (a) and (b) above, and also a control paper which had not been backcoated but was otherwise as in (b) above were each coated on their embossed surfaces with a conventional curable polyvinyl chloride composition and then cured in an oven, cooled by means of a cooling roll and re-wound. The resulting artificial leather products were then stripped off, and the casting papers were each re-used for a second-pass casting operation. The degree of curl of the paper was assessed at five different stages for each.

(i) prior to application of the curable composition
(ii) after application of the curable composition but before curing
(iii) after curing but before reaching the cooling roll
(iv) between the cooling roll and the rewind station
(v) immediately prior to the rewind station The curl assessment was done visually by reference to a fixed measuring scale during the coating and curing operations. The results were as set out in the table below.

TABLE

| | | Stage of Measurement | | | | |
|---|---|---|---|---|---|---|
| Backcoat Type | Pass | (i) | (ii) | (iii) | (iv) | (v) |
| Starch | First | 8D | 1D | 28D | 15D | 8D |
| | Second | 3U, then 1D | 1U | 14D | 12U, then 12D | 5D |
| Polyvinyl Alcohol | First | 0 | 1U | 3D | 9U | 3U |
| | Second | 6U | 2U | 2D | 3U | 1U |
| None (control) | First | 15U | 10U | 3U | 23U | 10U |
| | Second | 7U | 6U | 4U | 13U | 8U |

The curl measurements given in the table refer to the height in mm of the edge of the web above or below the middle of the web as viewed in the direction of web movement. U refers to an upwards curl and D to a downwards curl.

It will be seen that the polyvinyl alcohol backcoat give the best results, with much better curl performance than the control paper. The starch backcoat also gave significant improvements, except in relation to the intermediate stage (iii) of the process. It is theorized that this difference is because starch is less temperature stable in terms of its dimensions than polyvinyl alcohol.

We claim:

1. A method of producing casting paper of a desired surface texture or finish, comprising the steps of heating the polymer coating of a polymer-coated paper to a temperature sufficient to melt the polymer and then cooling the polymer coating from its molten state to a solid state as it passes through a nip between an embossing roll having a surface configuration corresponding to said desired surface texture or finish and a backing roll, thereby to deform both the polymer coating and underlying paper and to impart the surface configuration of the embossing roll to the polymer-coated paper and produce a casting paper.

2. A process as claimed in claim 1 wherein the polymer is polyolefinic.

3. A process as claimed in claim 2 wherein the polymer is poly(4-methyl-1-pentene).

4. A process as claimed in claim 2 wherein the polymer comprises polypropylene and a minor proportion of polyethylene.

5. A process according to claim 1, wherein the surface of the embossing roll is heated such that its surface temperature is above ambient temperatures but below the melting point of the polymer.

6. A process according to claim 3, wherein the embossing roll is heated such that its surface temperature is from 80° to 130° C.

7. A process according to claim 4, wherein the embossing roll is heated such that its surface temperature is from 80° to 100° C.

8. A process according to claim 1, wherein moisture is applied to the reverse surface of the polymer-coated paper whilst and/or before the polymer-coated paper is pre-heated to melt the polymer.

9. A process as claimed in claim 8 wherein said moisture is applied by means of steam showers.

10. A process according to claim 1, wherein moisture is applied to the reverse surface of the polymer-coated paper after the embossing stage.

11. A process according to claim 1, wherein a back coat of a hydrophilic polymer is applied to the paper after the embossing stage to enhance the curl resistance of the casting paper.

12. A process as claimed in claim 11 wherein said back coat comprises a polyvinyl alcohol.

13. A process as claimed in claim 12 wherein the polyvinyl alcohol is a substantially fully-hydrolysed medium molecular weight polyvinyl alcohol.

14. A process according to claim 1, wherein the polymer coating is heated by means of infra-red radiant heaters.

15. Casting paper produced by a process according to claim 1.

16. Surface-cast products made using casting paper as claimed in claim 15.

17. A process according to claim 5, wherein the embossing roll is heated such that its surface temperature is from 80° to 130° C.

18. A process according to claim 17, wherein the embossing roll is heated such that its surface temperature is from 80° to 100° C.

* * * * *